United States Patent [19]

Scholle et al.

[11] Patent Number: 4,460,025

[45] Date of Patent: Jul. 17, 1984

[54] FILLING VALVE ASSEMBLY WITH FIBER SHEARING EDGE

[76] Inventors: William J. Scholle, 4072 Belvedere, Irvine, Calif. 92714; William Lloyd-Davies, 21703 Ocean Vista #202, South Laguna, Calif. 92677

[21] Appl. No.: 343,919

[22] Filed: Jan. 29, 1982

[51] Int. Cl.[3] ..... B65B 3/04; B67C 3/28

[52] U.S. Cl. ..... 141/1; 141/90; 137/244; 222/148

[58] Field of Search ..... 141/89–92, 141/98, 285–310, 258, 259, 260, 261, 262, 392, 1–12; 137/244; 222/148, 149, 150, 151; 17/33, 35, 41

[56] References Cited

U.S. PATENT DOCUMENTS

| | | | |
|---|---|---|---|
| 497,127 | 5/1893 | Matthews et al. . | |
| 2,037,873 | 4/1936 | Angell | 137/244 |
| 2,710,121 | 6/1955 | Rees | 137/244 |
| 2,881,783 | 4/1959 | Andrews | 137/244 |
| 3,811,483 | 5/1974 | Morrison | 141/1 |
| 3,890,675 | 6/1975 | Nausedas . | |

*Primary Examiner*—Houston S. Bell, Jr.

*Attorney, Agent, or Firm*—Knobbe, Martens, Olson & Bear

[57] ABSTRACT

A filling nozzle for liquid or viscous material includes an outlet conduit through which the material flows, a valve mechanism that fits into the conduit to close the conduit, a knife edge connected to the valve mechanism, so that as the valve mechanism moves through the conduit the knife edge scrapes the interior surface of the nozzle and makes a wiping cut of any fibers or lumps in the material being dispensed through the nozzle, and an outlet in the valve mechanism so that a blast of pressurized gas can be directed through the valve mechanism to discharge any material remaining in the conduit downstream of the valve mechanism and knife edge.

14 Claims, 3 Drawing Figures

Fig. 1
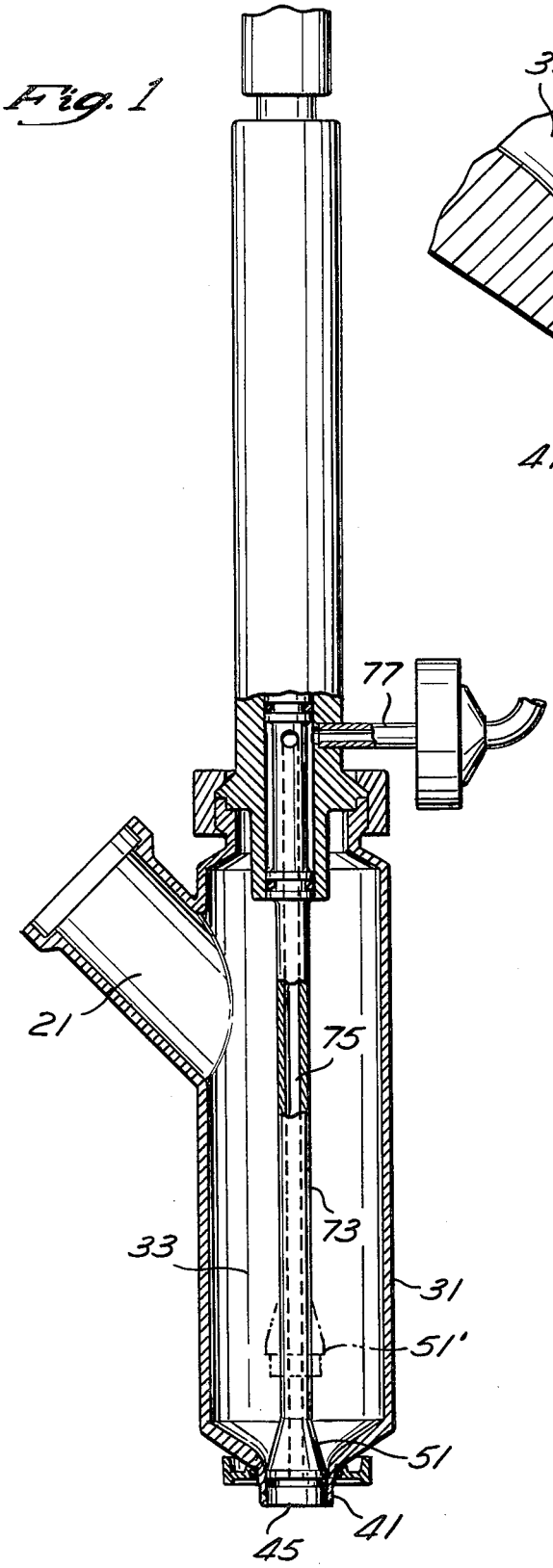
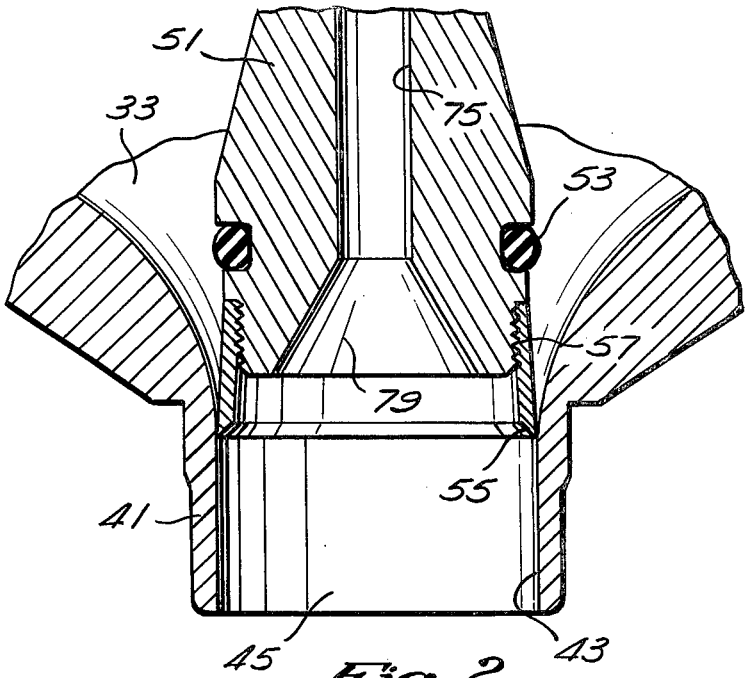
Fig. 2
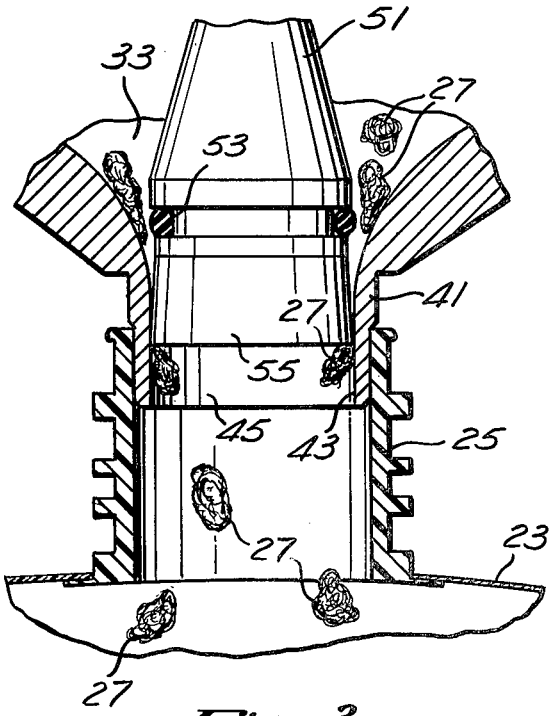
Fig. 3

FILLING VALVE ASSEMBLY WITH FIBER SHEARING EDGE

BACKGROUND OF THE INVENTION

This invention relates to automated apparatus for filling a succession of containers with liquid or viscous materials, and is particularly useful with food products where cleanliness and sanitation is important.

U.S. Pat. No. 3,926,229 discloses a filling head or nozzle, wherein the material to be dispensed through the nozzle is pumped through a passageway and an outlet opening. A valve mechanism reciprocates a valve member vertically in the device to open and close the outlet opening. The device disclosed in that patent includes a means for introducing a stream of fluid against the residual viscous material that remains in the filling head after the material valve has been closed. This fluid stream, which need only be momentary, discharges the material remaining in the filling head, so that at the end of each filling operation no material is left on the nozzle.

While this device works adequately for many materials, fibers or lumps in some materials such as crushed pineapple may become trapped between the valve member and the interior surface of the outlet opening when the valve is moved into the nozzle opening to close off the nozzle. The momentary fluid stream, or blast, cannot dislodge the trapped particles. When the spout of container that has been filled is removed from the nozzle before the spout of the next container to be filled is fitted to the nozzle, these fibers and lumps remain on the nozzle, and are exposed to the environment outside of the filling head, an environment that may contaminate or otherwise adversely affect the quality of the material. Additionally, these trapped fibers and lumps prevent the formation of a tight seal between the valve member and the outlet opening walls, thus increasing the possibility of contamination entering the material passageway.

SUMMARY OF THE INVENTION

In a device for dispensing a liquid or viscous material that comprises a passageway communicating with a source of liquid or viscous material, an outlet nozzle and valve member are installed that ensure that fibers and lumps in the material that are caught between the valve member and the nozzle are cut as the valve member closes off the nozzle opening. This ensures a complete isolation of the material upstream in the nozzle from the material downstream. The outlet nozzle of the invention, which communicates with the passageway and the source of the material, has an interior surface that defines a conduit for the flow of the material. The interior surface of the nozzle is slightly tapered from the upstream end of the nozzle toward the downstream end, so that the cross-sectional area of the conduit is slightly smaller at the downstream end of the nozzle than at the upstream end. The valve member or plug fits into the conduit and can be moved through at least a portion of the conduit as its closes off the outlet nozzle. A knife edge is coupled to the valve member in such a way as to scrape the tapered interior surface of the nozzle as the valve member is moved through the conduit to cut fibers and lumps in the material as the nozzle outlet is closed off. The knife edge is preferably an annular blade attached to the perimeter of the downstream side of the valve member.

The valve member included in the present invention also includes a means for introducing a blast of fluid into the downstream end of the conduit to completely discharge any material in the downstream end of the conduit. This, combined with the knife edge, permits the nozzle to be cleaned of any product remaining after the nozzle has been closed so that no product is exposed to possible contamination between filling operations.

BRIEF DESCRIPTION OF THE DRAWINGS

FIG. 1 is an elevational view of the filling head of the present invention partially in cross-section.

FIG. 2 is a cross-sectional view of the nozzle and valve member of the present invention.

FIG. 3 shows the valve member and nozzle with the spout of a container to be filled attached.

DETAILED DESCRIPTION OF THE PREFERRED EMBODIMENT

The filling apparatus incorporating the present invention is shown in FIG. 1. The apparatus includes a main body 31 with an outlet nozzle 41 at one end. Chamber 33 communicates through passageway 21 with a source (not shown) of the liquid or viscous material that is to be dispensed through the outlet nozzle 41. Outlet opening 45 permits the material to flow from chamber 33 through outlet nozzle 41. Located approximately centrally within the main body 31 is tubular shaft 73 defining internal conduit 75 and having on its end valve member or plug 51. Valve member 51 is shaped and sized to fit into outlet opening 45 to block the flow of the liquid or viscous material through the opening. The plug or valve member is also shown at 51 withdrawn from the nozzle to permit the liquid or viscous material to flow through the outlet opening 45.

Internal conduit 75 of shaft 73 communicates through conduit 77 with a source of pressurized fluid, preferably an inert gas such as nitrogen. Through these conduits 75 and 77, a blast of the inert gas can be supplied to the outlet opening 45 when valve member 51 is in place in the outlet opening 45, to discharge material in the outlet opening 45 downstream of the plug 51.

The mechanism for controlling the movement of shaft 73 (including valve member 51) and the means for supplying the inert fluid through conduit 75 to outlet nozzle 41 is further described in U.S. Pat. No. 3,926,229, issued to William R. Scholle and assigned to Scholle Corporation.

The outlet nozzle 41 and valve member or plug 51 of the present invention are shown in FIGS. 2 and 3. Referring to FIG. 2, outlet nozzle 41 includes an interior surface 43 that defines the outlet opening or conduit 45 for the material to be dispensed through the outlet nozzle 41. This conduit 45 may have a cross-section of virtually any shape, but for simplicity of construction and ease of operation, a circular cross-section is generally most advantageous. The interior surface 43 of the outlet nozzle 41 tapers or converges very slightly in the downstream direction so that the cross-sectional area of the conduit 45 is slightly smaller at the downstream end of the nozzle 41 that it is at the upstream end. Experiments have indicated that providing interior surface 43 with a taper of approximately 1° through a length of approximately one inch provides adequate performance of the invention. The outer surface of the outlet nozzle 41 is adapted to receive the spout 25 of a container 23 to be filled with the liquid or viscous material (FIG. 3).

Referring again to FIG. 2, a knife blade 55 is coupled to the valve member 51. This knife blade 55 has the same shape as the cross-sectional shape of conduit 45 of the outlet nozzle 41. The outside diameter of the knife blade 55 is approximately the same as the diameter of the conduit 45 at its upstream end. Thus, knife blade 55 contacts interior surface 43 when the valve member 51 is at the upstream end of the conduit 45 as shown in FIG. 2. As the valve member 51 is moved in a downstream direction, the knife blade 55 scrapes the tapered interior surface 43 to make a wiping cut of any material that is caught between the knife blade 55 and the interior surface 43. Knife blade 55 is preferably releasably attached to valve member 51, such as by threads 57. This enables removal of the knife blade when it becomes dull, and so that it may be replaced with a sharp blade so an effective cutting capability is maintained.

O-ring 53 encircling valve member 51 ensures that when valve member 51 has closed off outlet 41, a tight seal is maintained so that no contamination from outside the device enters the chamber 33.

Internal conduit 75, which extends from conduit 77 through hollow shaft 73 (FIG. 1) and through valve member 51, terminates in flared opening 79 (FIG. 2). The flared opening 79 causes the pressurized fluid that comes through conduit 75 to spread to the walls of the entire conduit 45 downstream of valve member 51. This blast of fluid can discharge the material in the conduit 45 that is downstream of the valve member 51, material that has been cut off by the scraping of knife edge 55 against the internal surface 43.

OPERATION OF THE INVENTION

Referring again to FIG. 1, a liquid or viscous material, such as crushed pineapple, is pumped through passageway 21 into cavity 33. When the valve member 51 is in the position indicated by reference numeral 51', the material passes from cavity 33 through the nozzle 41.

As shown in FIG. 3, a container 23 with a spout 25 is coupled to the outlet nozzle 41. When valve member 51 is removed from the conduit 45, the liquid or viscous material with which the container is to be filled flows from chamber 33, through conduit 45, through spout 25, and into the container 23.

When the container 23 is full, valve member 51 is brought into the conduit 45. As valve member 51 enters the upstream end of conduit 45, knife edge 55 contacts the interior surface 43 of outlet nozzle 41. This halts the flow of the material through the conduit 45. As valve member 51 is moved through conduit 45, knife blade 55 scrapes the slightly converging interior surface 43 of the nozzle 41, cutting any fibers or lumps 27 in the material that are caught between the plug 51 and the interior surface 43. This completely separates the material that is in the spout 25 and conduit 45 downstream of the valve member 51 from the material in the conduit 45 and the chamber 33 upstream of valve member 51.

After valve member 51 has completely closed conduit 45 and cut the fibers and lumps in the material in the conduit by moving to a point at which the knife blade 55 is near the downstream end of nozzle 41, a short blast of fluid, such as an inert gas, is directed through conduit 77 and down internal conduit 75 (FIG. 1). This gas is allowed to expand in flared outlet 79 as it enters the downstream portion of conduit 45 and spout 25 (FIG. 2). The momentary blast of inert gas dislodges any of the material that remains in conduit 45 downstream of plug 51, such as the portions of the fibers and lumps 27 that are cut off by knife blade 55. Thus, no material remains in the conduit 45 to be exposed to possible contamination from the environment surrounding the outlet nozzle 41 when the spout 25 of container 23 is removed from the nozzle 41.

We claim:

1. In a device for filling a container with a liquid or viscous material, comprising a passageway communicating with a source of said material, and means for propelling said material from said source through said passageway, the apparatus comprising:

(1) an outlet nozzle communicating with said passageway, said outlet nozzle having an interior surface defining a conduit for said material, and further having an upstream end and a downstream end, wherein:

(a) said downstream end of said outlet nozzle is adapted to communicate with the spout of a container to be filled; and (b) said interior surface being slightly tapered in the downstream direction so that the cross-sectional area of said conduit is slightly smaller at said downstream end than at said upper end;

(2) a valve member for closing said outlet nozzle, said valve member movable through at least a portion of said conduit as said valve member closes said outlet nozzle; and (3) a knife edge coupled to said valve member and adapted to scrape said interior surface of said outlet nozzle as said valve member moves through said conduit in the downstream direction to cut fibers and lumps in said liquid or viscous material so that when said outlet nozzle is closed by said valve member, the material upstream of said valve member is completely separated from the material downstream of said valve member.

2. The apparatus defined in claim 1, additionally comprising:

means for supplying a momentary blast of pressurized fluid through said valve member in a downstream direction to discharge any of said liquid or viscous material remaining in said conduit downstream of said valve member.

3. In a device for dispensing a liquid or viscous material, the apparatus comprising:

(1) a nozzle, including:

(a) an upstream end in communication with a source of said material;

(b) a downstream end; and (c) an interior surface defining a conduit for said material, said interior surface converging slightly toward said downstream end so that the cross-sectional area of said conduit gradually decreases through at least a portion of said nozzle in the downstream direction;

(2) valve means for stopping the flow of said material through said nozzle; and (3) a cutting edge adapted to scrape said interior surface of said nozzle at a slight angle to cut fibers and lumps in said material as said valve means stops said flow of said material, wherein said cutting edge completely separates said material upstream of said valve means from said material in said conduit downstream of said valve means.

4. The apparatus defined in claim 3, wherein:

said valve means comprises a valve member that is movable through at least a portion of said conduit as said valve means closes said nozzle; and said cutting edge is coupled to said valve member so that said cutting edge cuts fibers and lumps in said material as said valve member moves through said conduit.

5. The apparatus defined in claim 4, wherein:

said cutting edge scrapes said interior surface to cut fibers and lumps in said material as said valve member moves through said portion of said conduit in which said interior surface converges.

6. The apparatus defined in claim 5, wherein:

said conduit has a generally circular cross-section; and said cutting edge is an annular knife edge having a diameter approximately equal to the diameter of said conduit at the upstream end of said portion of said conduit in which said interior surface converges.

7. The apparatus defined in claim 6, wherein said interior surface converges with a taper of approximately 1°.

8. The apparatus defined in claim 7, wherein the portion of said conduit through which said valve member moves is approximately one inch in length.

9. The apparatus defined in claim 3 additionally comprising:

means for discharging said liquid or viscous material in said conduit downstream of said cutting edge.

10. The apparatus defined in claim 9, wherein said means for discharging said material from said conduit comprises:

means for supplying a momentary blast of pressurized fluid to said conduit downstream of said cutting edge.

11. A method of stopping the flow of a liquid or viscous material through a nozzle having an internal surface defining a conduit for the flow of said material, and having an upstream end communicating with a source of said material and a downstream end, said interior surface converging slightly toward said downstream end so that the cross-sectional area of said conduit gradually decreases through at least a portion of said nozzle in the downstream direction, comprising:

placing a plug in said conduit to close off the flow of said material through said conduit;

scraping a knife edge along said interior surface to make a wiping cut of fibers and lumps in said material to completely separate any of said material that is downstream of said plug from any of said material that is upstream of said plug.

12. The method of claim 11, wherein said knife edge is coupled to said plug, additionally comprising the step of:

moving said plug through at least a portion of said conduit, so that said knife edge grazes said interior surface to make said wiping cut as said plug is moved through said conduit.

13. The method defined in claim 11, additionally comprising the step of:

discharging any of said liquid or viscous material in said conduit downstream of said plug after making said wiping cut of fibers and lumps in said material.

14. The method defined in claim 13, wherein said step of discharging said material downstream of said plug comprises:

supplying a momentary blast of pressurized fluid to said conduit downstream of said plug.

* * * * *